US005768668A

United States Patent [19]

Shiraki et al.

[11] Patent Number: 5,768,668

[45] Date of Patent: Jun. 16, 1998

[54] TONER SUPPLY ROLL HAVING OPENINGS IN SKIN LAYER OF POROUS CYLINDRICAL POLYURETHANE SPONGE STRUCTURE, AND METHOD OF PRODUCING THE SAME

[75] Inventors: Keita Shiraki; Saburou Hayashi, both of Kasugai; Akitoshi Nozawa, Komaki; Mitsuyoshi Kondo, Inuyama, all of Japan

[73] Assignee: Tokai Rubber Industries, Ltd., Japan

[21] Appl. No.: 790,858

[22] Filed: Feb. 3, 1997

[30] Foreign Application Priority Data

Feb. 6, 1996 [JP] Japan ..... 8-020098
Jun. 14, 1996 [JP] Japan ..... 8-154358

[51] Int. Cl.[6] ..... G03G 15/08

[52] U.S. Cl. ..... 399/281; 264/46.7; 264/46.9; 492/37

[58] Field of Search ..... 399/281, 272; 29/895.32; 264/46.5, 46.6, 46.7, 46.9; 492/18, 30, 37, 56

[56] References Cited

U.S. PATENT DOCUMENTS 4,696,255 9/1987 Yano et al. ..... 399/281
4,788,570 11/1988 Ogata et al. ..... 399/283
5,311,264 5/1994 Kinoshita ..... 399/281
5,655,197 8/1997 Okada et al. ..... 399/281

FOREIGN PATENT DOCUMENTS 3-155575 7/1991 Japan .
4-55873 2/1992 Japan .
6-301281 10/1994 Japan .

*Primary Examiner*—Joan H. Pendegrass
*Attorney, Agent, or Firm*—Parkhurst & Wendel, L.L.P.

[57] ABSTRACT

A toner supply roll including a metal shaft and a cylindrical soft polyurethane sponge structure formed on an outer circumferential surface of the metal shaft by foam molding of a polyurethane material in a mold cavity of a mold. The sponge structure having a hardness of 350 g or lower includes a skin layer having generally smooth surface and openings, and a network of cells. The openings are open in the smooth surface and communicate with respective ones of the cells located adjacent to the skin layer, such that the openings are substantially aligned with central portions of the respective ones of the cells in axial and radial directions of the sponge structure. Each opening has a size within a range of 100–800 μm, and a total area of the openings is at least 20% of a total area of the smooth surface of the skin layer. The method of producing the roll is also disclosed.

20 Claims, 9 Drawing Sheets

FIG. 3 (a)-1
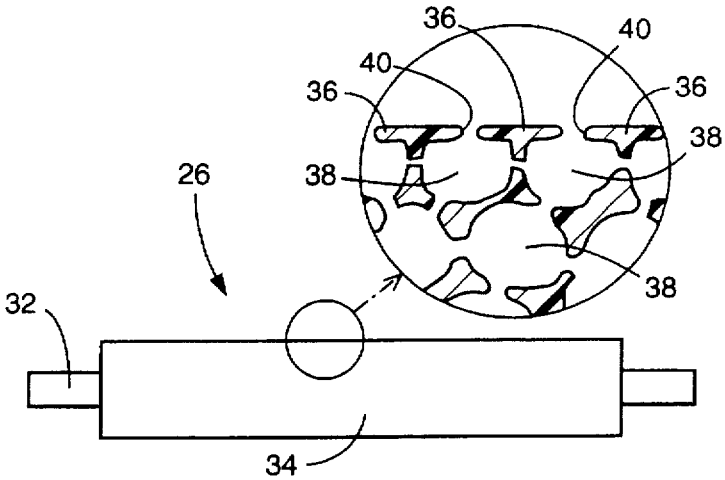
FIG. 3 (a)
FIG. 3 (b)-1
PRIOR ART
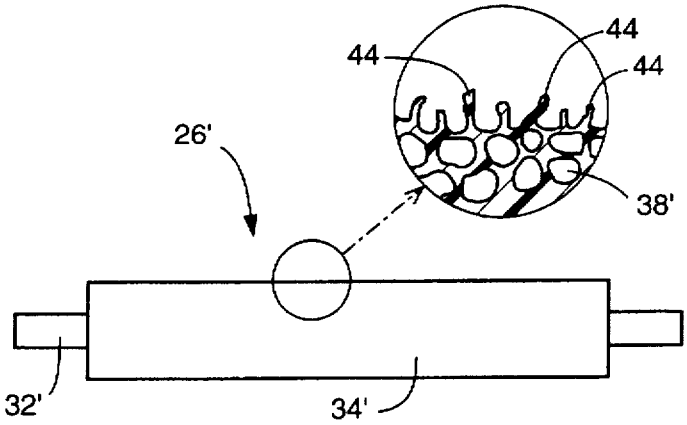
FIG. 3 (b)
PRIOR ART
FIG. 3 (c)-1
PRIOR ART
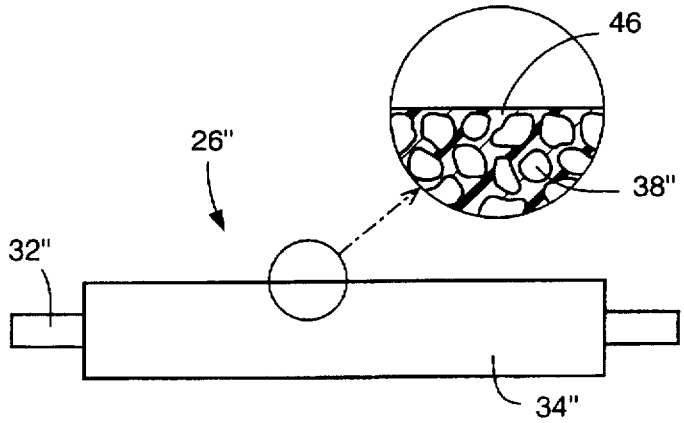
FIG. 3 (c)
PRIOR ART

TONER SUPPLY ROLL HAVING OPENINGS IN SKIN LAYER OF POROUS CYLINDRICAL POLYURETHANE SPONGE STRUCTURE, AND METHOD OF PRODUCING THE SAME

This application is based on Japanese Patent Applications No. 8-020098 filed Feb. 6, 1996 and No. 8-154358 filed Jun. 14, 1996, the content of which is incorporated hereinto by reference.

BACKGROUND OF THE INVENTION

1. Field of the Invention

The present invention relates in general to a toner supply roll for transferring a toner, and a method of producing such a toner supply roll, and more particularly to a toner supply roll incorporated in an image developing device used in an image forming apparatus such as copying apparatus, image recording apparatus, printer and facsimile, and a method suitable for producing such a toner supply roll. The image developing device is adapted to develop an electrostatic latent image into a visible image consisting of a toner or developer. The visible image is formed on a suitable image bearing medium such as a photoconductive or photosensitive medium used in electrophotography, and a dielectric medium used in electrostatic recording. The toner supply roll functions to transfer the toner to such an image bearing medium for developing the latent image into the visible image.

2. Discussion of the Related Art

In such known copying, recording, printing, facsimile reception and other image forming apparatus, an electrostatic image formed on a photoconductive or electrostatic dielectric image-bearing medium is developed by an image developing device into a visible image by transfer of a toner to selected local spots on the imagewise exposed image-bearing medium. The image developing device has a hopper accommodating a mass of the toner (developer), and incorporates a toner supply roll which is a soft elastic roll adapted to supply the toner to the image-bearing medium.

For instance, the toner supply roll used in such an image bearing device is an elastic roll of a polyurethane foam or sponge structure, as disclosed in JP-A-3-155575. Several methods are proposed to produce or manufacture such an elastic roll. These method include: method A including the steps of obtaining a roll by cutting a slab of a foam product generated by foaming a material in a mold, inserting a metal shaft through the roll, and grinding or polishing the circumferential surface of the roll to finish the roll into the desired shape; method B including the steps of foaming a material in a mold so as to form a cylindrical sponge structure on a metal shaft, and grinding the sponge structure to remove an unnecessary portion for thereby obtaining the desired toner supply roll; and method C wherein a sponge structure is formed on a metal shaft in the same manner as in the method B, but the grinding step is not implemented.

However, the conventional methods A, B and C of producing the elastic roll suffer from various potential problems. For example, the methods A and B include the complicated process steps, and suffer from fluffing of the surface of the roll due to the grinding step, namely, generation of undesirable burrs or fuzz left on the ground or polished surface of the roll, and unsatisfactory dimensional accuracy of the roll. Although the method C is free from such problems, this method does not permit the skin layer of the roll to have a sufficiently large thickness. The insufficient thickness of the skin layer may cause easy breakage of the skin layer due to friction resistance during use of the roll as the toner supply roll, in which the roll is held in rolling contact with an image developing roll. Thus, the method C does not assure sufficient durability of the roll.

The durability of the elastic roll produce according to the method C may be increased by: 1) increasing the density of the sponge structure and increasing the thickness of the skin layer, so as to increase the strength of the skin layer, 2) improving the physical properties (tensile strength, elongation and hardness) of the roll, or 3) employing a so-called "integral skin foam" which facilitates the formation of the skin layer. These measures, however, all result in increasing the hardness of the foam or sponge structure of the roll. Generally, the toner supply roll is required to have a high degree of flexibility as well as a high level of durability. The method C does not permit these two requirements to be satisfied simultaneously.

The elastic toner supply roll of the image developing device is required to have a function of supplying a suitably controlled amount of the toner to the image developing roll, so that the toner is uniformly distributed on the developing roll. The surface of the toner supply roll produced according to the known methods A and B tends to be fluffed or given burrs or fuzz, leading to instability of the amount of the toner to be transferred to the image developing roll, and resulting in deteriorated quality of an image reproduced by the toner. Further, the burrs removed from the toner supply roll may act as foreign matters which may be unfavorably left in the other portions of the image forming apparatus, resulting in the deteriorated quality of the reproduced image and malfunction of the apparatus.

The elastic toner supply roll produced according to the known method C suffers from the problem of foreign matters as indicated above with respect to the methods A and B, namely, removal of fragments of the material of the sponge structure due to breakage of the skin layer of the sponge structure as described above. Further, the toner is likely to enter the sponge structure through the broken portions of the skin layer, resulting in hardening of the broken portions, that is, local hardening of the sponge structure of the roll, which may cause instability of the amount of the toner to be transferred from the roll.

Where the sponge structure is an independent-cell type structure wherein the cells do not communicate with each other, the walls of the cells of the cellular network of the sponge structure tends to be broken due to contact of the toner supply roll with the image developing roll, whereby the air permeability of the cellular network tends to increase during use of the roll. Accordingly, the toner tends to easily enter the cellular structure, causing local hardening of the roll and deteriorated image quality as described above.

SUMMARY OF THE INVENTION

It is therefore a first object of the present invention to provide a toner supply roll which is less likely to suffer from the conventionally experienced problems of fluffing of the surface of the sponge structure, instability of transfer of the toner, and deteriorated dimensional accuracy.

It is a second object of the present invention to provide a toner supply roll which is less likely to suffer from the conventionally experienced problems of deteriorated durability and foreign matters due to breakage of the skin layer of the sponge structure, and local hardening of the sponge structure due to entry of the toner inside the sponge structure.

It is a third object of this invention to provide a method suitable for producing such a toner supply roll, without complicated steps.

The first and second objects indicated above may be achieved according to one aspect of the present invention, which provides a toner supply roll comprising a metal shaft, and a cylindrical soft polyurethane sponge structure formed on an outer circumferential surface of the metal shaft by foam molding of a polyurethane material in a mold cavity of a mold, which mold cavity has a configuration corresponding to a desired shape of the sponge structure. The cylindrical soft polyurethane sponge structure has a hardness of not higher than 350 g, and includes a skin layer which has a generally smooth surface. The cylindrical sponge structure further has a network of cells, and the skin layer has openings which are open in the generally smooth surface thereof and which communicate with respective ones of the cells which are located adjacent to the skin layer. The openings are substantially aligned with central portions of the respective ones of the cells in axial and radial directions of the cylindrical sponge structure. Each of the openings has a size which falls within a range of 100–800 μm. A total area of the openings is at least 20% of a total area of the generally smooth surface of the skin layer.

In the toner supply roll constructed as described above according to the first aspect of this invention, the cylindrical soft polyurethane sponge structure is formed on the outer circumferential surface of the metal shaft by foam molding of the selected polyurethane material in the mold cavity. The skin layer has a generally smooth surface, although the openings communicating with the cells are formed through the skin layer. Since the toner supply roll is formed by foam molding and is not subjected to a grinding or polishing process as performed in the conventional method, the surface of the soft polyurethane sponge layer of the roll is not fluffed with burrs or fuzz, which would cause instable transfer of the toner from the roll. The present toner supply roll is therefore less like to suffer from or is free from the deterioration of the quality of the reproduced image and malfunctioning of an image forming apparatus due to the removal of the burrs as foreign matters. Further, the present toner supply roll has improved dimensional accuracy in the absence of the fluffing of the sponge structure.

In addition, the toner supply roll of the present invention is characterized by the openings formed through the portions of the skin layer which are substantially aligned with the central portion of the cells in the axial and radial directions of the cylindrical sponge structure. Those portions of the skin layer would be thinned in the presence of the cells located adjacent to the skin layer, if the openings are not formed in place of those portions. Namely, the openings which are open in the surface of the skin layer and communicate with the cells adjacent to the skin layer make it possible to eliminate those portions of the skin layer which are thinned in the presence of the cells in the conventional toner supply roll. In the present toner supply roll, the skin layer will not be broken during use in an image forming apparatus, leading to improved durability and elimination of foreign matters in the absence of fluffing of the skin layer as encountered in the conventional toner supply roll. Further, since the openings are open in the surface of the skin layer and communicate with the cells adjacent to the skin layer, the toner is likely to enter the inside of the sponge structure through the openings, with even distribution of the toner throughout the sponge structure, and can be relatively easily discharged from the sponge structure, whereby the sponge structure is less likely to suffer from local hardening, which is conventionally experienced due to the local breakage of the skin layer and resulting entry of the toner through the broken portions of the skin layer.

According to one preferred form of the toner supply roll of the invention, the cylindrical soft polyurethane sponge structure has air permeability which permits a rate of air flow therethrough of not higher than 30 $cc/cm^2 \cdot second$ when one of axial opposite ends of the sponge structure is exposed to an atmospheric pressure while the other of the axial opposite ends is exposed to a reduced pressure of 100 mm $H_2O$. This air permeability means a relatively small degree of mutual communication of the cells, which is effective to prevent the toner flowing from the cells adjacent to the skin layer into the cells remote from the skin layer, even if the toner has a relatively small particle size. Thus, the present form of the toner supply roll is less likely to suffer from local increase in the hardness of the toner supply roll even after a long period of use of the roll. Thus, the present toner supply roll assures improved quality of reproduced image for a long period of use.

According to another preferred form of the toner supply roll of the invention, the soft polyurethane sponge structure is an independent-cell type sponge structure wherein the cells do not substantially communicate with each other, and has an elongation of at least 100% and a tear strength of at least 0.4 kgf/cm. The independent-cell type sponge structure having such high degrees of elongation and tear strength is less likely to suffer from breakage or tearing of the walls of the cells during use of the roll even for a long period of time, thus assuring freedom from the conventionally experienced problems such as undesirable increase in the air permeability, local hardening of the polyurethane sponge structure.

The third object indicated above may be achieved according to a second aspect of this invention, which provides a method of producing a toner supply roll as described above, comprising the steps of: (a) preparing the mold such that at least an inner portion of the mold which partially defines the mold cavity is formed of a fluoro-resin material; (b) processing a surface of the inner portion of the mold so that the inner portion has a surface roughness Rz of 5–20 μm; (c) disposing the metal shaft in the mold such that the metal shaft and the inner portion cooperate to define the mold cavity; and (d) introducing the polyurethane material to be foamed to generate the cylindrical soft polyurethane sponge structure integrally bonded to the outer circumferential surface of the metal shaft. In the present method, the fluoro-resin material and the surface roughness of the inner portion of the mold permits the openings to be formed through the skin layer of the cylindrical soft polyurethane sponge structure in communication with the respective ones of the cells.

The third object may also be achieved according to a third aspect of this invention, which provides a method of producing a toner supply roll as described above, comprising the steps of: (i) preparing the mold such that an inner surface of the mold which partially defines the mold cavity is covered by a coating of a fluoro-resin material; (ii) processing a surface of the coating of the fluoro-resin material so that the coating has a surface roughness Rz of 5–20 μm; (iii) disposing the metal shaft in the mold such that the metal shaft and the coating cooperate to define the mold cavity; and (iv) introducing the polyurethane material into the mold cavity and causing the polyurethane material to be foamed to generate the cylindrical soft polyurethane sponge structure integrally bonded to the outer circumferential surface of the metal shaft. In the present method, the fluoro-resin material and the surface roughness of the coating permits the openings to be formed through the skin layer of the cylindrical soft polyurethane sponge structure in communication with the respective ones of the cells.

BEST AVAILABLE COPY

In the methods according to the second and third aspect of the present invention, the toner supply roll is produced by simply foaming the selected polyurethane material in the mold cavity so as to generate the cylindrical soft polyurethane sponge structure on the outer circumferential surface of the metal shaft. The present methods do not require cumbersome operations such as cutting, grinding and surface finishing as performed in the known methods, and permit easy and efficient production of the toner supply roll.

Preferably, the method according to the second aspect of this invention further comprises a step of applying a mold releasing agent to the surface of the inner portion of the mold, and the method according to the third aspect of the invention further comprises a step of applying a mold releasing agent to the surface of the coating of the fluororesin material. The mold releasing agent permits the openings to be suitably formed through the skin layer of the sponge structure. In another preferred form of the above methods, the mold is prepared by using a pipe as part of the mold, such that the inner circumferential surface of the pipe partially defines the mold cavity. The use of the pipe permits simple construction and economical manufacture of the mold.

BRIEF DESCRIPTION OF THE DRAWINGS

The above and other objects, features and advantages of this invention will be better understood by reading the following detailed description of presently preferred embodiments of the invention, when considered in connection with the accompanying drawings, in which:

FIG. 3(*a*) is an enlarged view in cross section of a part of a toner supply roll constructed according to the present invention, and FIG. 3(*b*) and FIG. 3(*c*) are enlarged cross sectional views which respectively show examples of known toner supply rolls constructed according to conventional methods;

DETAILED DESCRIPTION OF THE PREFERRED EMBODIMENTS

Figure 1:
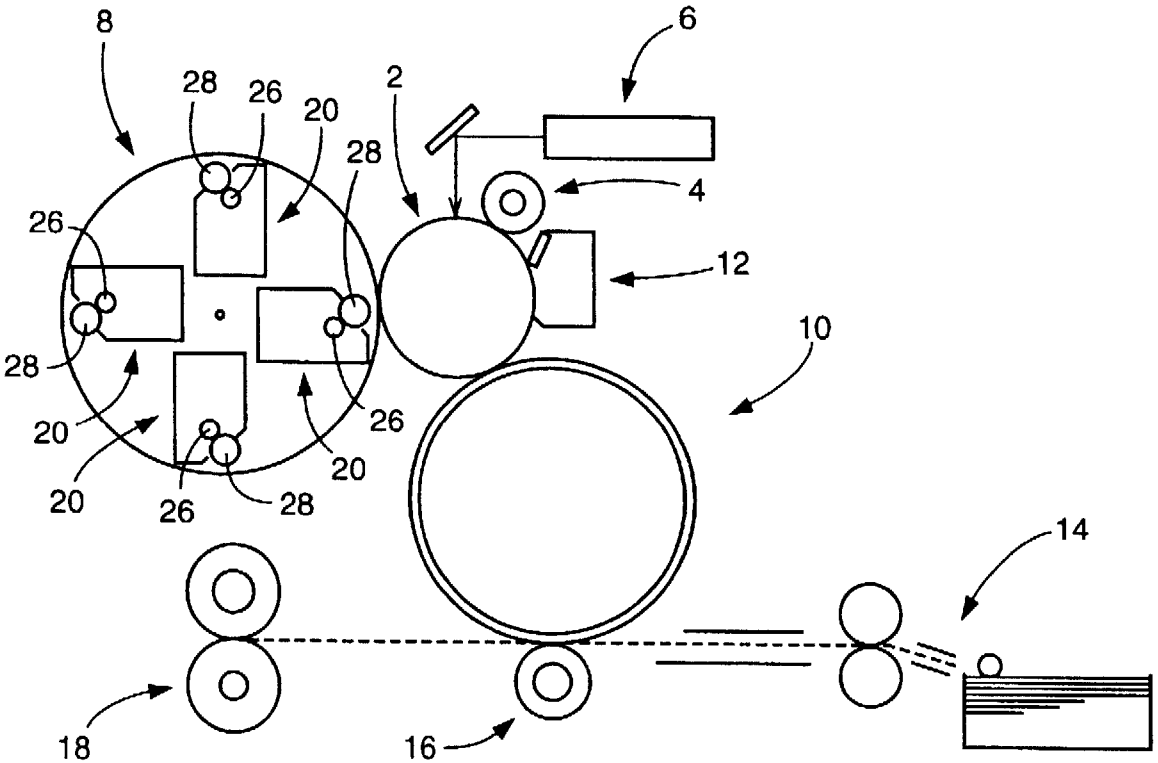
FIG. 1 is a schematic elevations view illustrating a construction of a full-color laser printer using a toner supply roll according to one embodiment of the present invention.

Referring first to FIG. 1, there is schematically shown a full-color laser printer wherein a toner supply roll according to one embodiment of the present invention is used. The laser printer illustrated in FIG. 1 is equipped with a photosensitive drum 2. Around this photosensitive drum 2, there are arranged a charging roll 4, a laser scanner 6, an image developing device 8, an image transferring drum 10 and a cleaning device 12, substantially in the order of description. A surface of the photosensitive drum 2 is electrostatically charged by the charging roll 4. The laser scanner 6 is adapted to generate a laser beam as image information, which imagewise exposes the surface of the photosensitive drum 2 so as to form an electrostatic latent image corresponding to the image information. The image developing device 8 is provided to apply a powdered toner to the electrostatically charged surface area of the photosensitive drum 2, for thereby forming a visible image which consists of the toner. The visible toner image is transferred from the surface of the photosensitive drum 2 onto a surface of the image transferring drum 10. The toner image transferred onto the transferring drum 10 is further transferred onto a recording surface of a sheet of recording paper, which is fed from a paper supply 14, along a feed path between the image transferring drum 10 and an image transferring roll 16. The toner image transferred onto the recording surface of the sheet is fixed by a fixing device 18.

The present laser beam printer is adapted to effect full-color printing, that is, the image developing device 8 consists of four developing units 20, which accommodate four kinds of color toners i.e., cyan, yellow, magenta and black toners, respectively. As the color toners, a non-magnetic one component developer may be employed. The four developing units 20 are disposed around an axis of rotation of the developing device 8 such that the units 20 are equally spaced from each other at an angular interval of 90°. Thus, the photosensitive drum 2 is adapted to contact with each of the developing units 20 each time the developing device 8 is rotated by 90° about its axis, whereby the drum 2 is provided with the four color toners (color developers), so that the latent image formed on the photosensitive drum 2 is developed into a visible color image.

Figure 2:
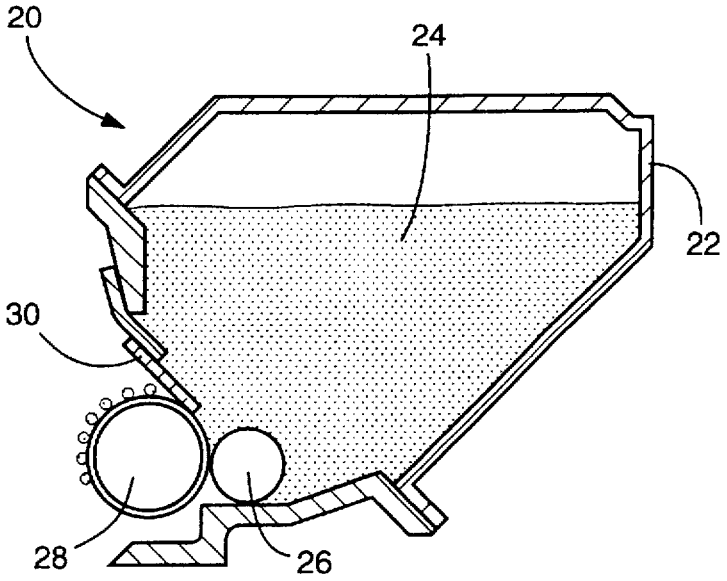
FIG. 2 is an enlarged view in cross section of one of developing units of the laser printer of FIG. 1.

As is clearly shown in FIG. 2, each developing unit 20 of the image developing device 8 comprises a hopper 22 in which a mass of powdered toner 24 as a color developer (non-magnetic one-component developer) is contained. The developing unit 20 further comprises a toner supply roll 26 and a developing roll 28 which are disposed in the lower portion of the hopper 22 such that a circumferential surface of the toner supply roll 26 is in rolling contact with a surface of the developing roll 28, so that the powdered toner 24 contained in the hopper 22 is supplied or transferred to the developing roll 28. Near the developing roll 28, there is disposed a toner-layer forming blade 30 by which the thickness of a toner layer formed on the developing roll 28 is suitably determined. As is apparent from the above description, the surface of the developing roll 28 of each developing unit 20 is brought into contact with the circumferential surface of the photosensitive drum 2 when the developing device 8 is rotated by 90°, so that the powdered toner of the toner layer formed on the developing roll 28 is transferred onto the surface of the photosensitive drum 2, whereby the electrostatic latent image formed on the photosensitive drum 2 is developed.

BEST AVAILABLE COPY

The present invention relates to the toner supply roll 26 used in each developing unit 20 of the developing device 8 which is provided on the laser printer constructed as described above. The toner supply roll 26 includes a center metal shaft and a cylindrical soft polyurethane sponge structure which is integrally formed on the metal shaft by a foam molding. The polyurethane sponge structure has a skin layer having a generally smooth outer surface, and a multiplicity of cells formed below the skin layer. The cells adjacent to the skin layer are exposed in the surface of the skin layer through openings formed through the skin layer. One example of the toner supply roll 26 of the present invention is shown in FIG. 3(*a*).

As shown in FIG. 3(*a*), the toner supply roll 26 consists of a metal shaft 32 which functions as an axis of rotation, and a cylindrical soft polyurethane sponge structure 34 which is formed on and integrally with the metal shaft 32. The toner supply roll 26 constructed as described above, may be prepared by disposing the metal shaft 32 in a mold and injecting a polyurethane material into a mold cavity whose configuration corresponds to a desired shape of the toner supply roll 26. In this arrangement, the polyurethane sponge structure 34 having a hardness of not higher than 350 g is formed on and integrally with the metal shaft 32, with a desired thickness.

As shown in the enlarged view of FIG. 3(*a*), the soft polyurethane sponge structure 34 formed on the metal shaft 32 has a skin layer 36 which has generally smooth outer surface. Through the skin layer 36, there are formed a multiplicity of openings 40 which communicate with respective cells 38 formed and located adjacent to the skin layer 36, so that the cells 38 are open in the surface of the skin layer 36 through the openings 40. Each opening 40 has a opening diameter of 100–800 μm (size as measured in the plane of the skin layer 36). Thus, the skin layer 36 is made porous with the openings 40. Each opening 40 is formed in a portion of the skin layer 36 which is located at a central portion of the corresponding cell 38 where the skin layer 36 has the smallest thickness. This arrangement eliminate the conventionally provided thin portions of the skin layer which correspond to the adjacent cells. The thus formed porous skin layer 36 having the openings 40 is free from the conventionally experienced problem of local breakage at its portions corresponding to the enclosed cells during use of the toner supply roll, which breakage may cause foreign substances to enter into the polyurethane sponge structure 34, namely, into the opened cells.

Figure 4A:
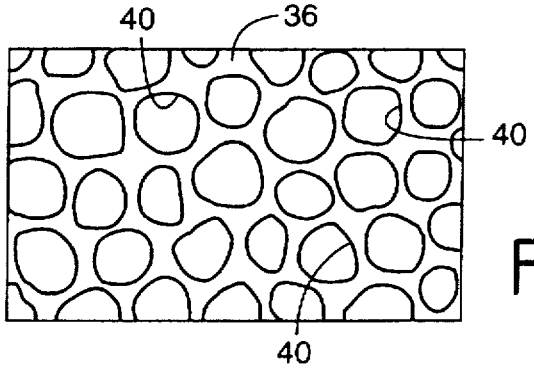
FIGS. 4(*a*), 4(*b*), and 4(*c*) are enlarged views showing a part of a surface of a skin layer of a soft polyurethane sponge structure of each of three examples of the toner supply roll constructed according to the present invention, whose openings in the skin layer have different diameters.
Figure 4B:
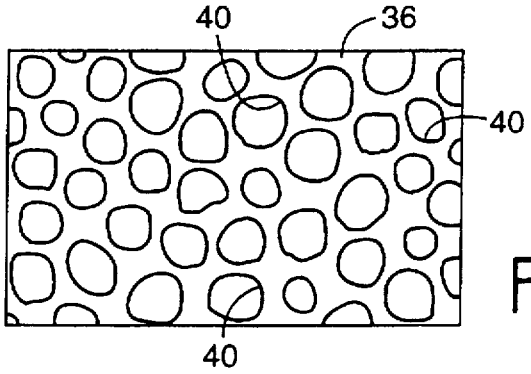
Figure 4C:
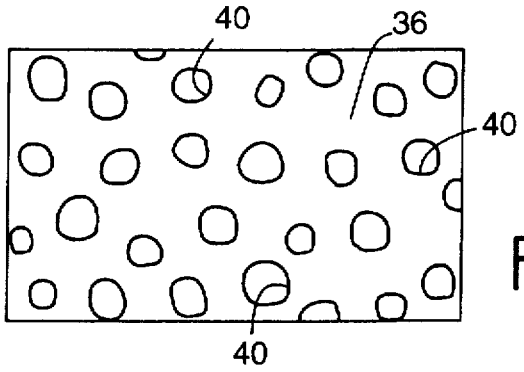

Referring next to the enlarged plane view of FIGS. 4(*a*), 4(*b*) and 4(*c*), there are shown three examples of the skin layers 36, wherein the openings 40 have different sizes or diameters. As clearly shown in these views, all of the skin layers 36 have generally smooth surfaces, although the smoothness of the surfaces more or less changes depending on the size of the openings 40. Each skin layer 36 is formed such that the total area of the openings 40 formed in the skin layer 36 is at leased 20% of the total surface area of the skin layer 36. This arrangement is effective to eliminate or reduce the portions of the skin layer 36 which are thinned by the adjacent enclosed cells 40. The present arrangement of the openings 40 is also effective to permit uniform flows of the powdered toner into and out of the open cells of the polyurethane sponge structure 34, thereby preventing local hardening of the polyurethane sponge structure 34. If the percent of the total area of the openings 40 to the total surface area of the skin layer 38 is lower than 20%, the toner supply capacity of the toner supply roll 26 is insufficient, and the polyurethane sponge structure 34 tends to be clogged with the toner. The portion of the polyurethane sponge structure 34 clogged with the powdered toner suffers from excessively high hardness, resulting in deterioration of the quality of an image reproduced by the laser printer. The upper limit of the area percent of the openings 40 with respect to the total area of the skin layer 36 is desirably determined. The upper limit is generally 80%, and preferably 70% or lower.

In the toner supply roll 26 constructed according to the present invention, the openings 40 of the cells 38 located adjacent to the skin layer 36 of the polyurethane sponge structure 34 has a generally circular shape as seen in FIG. 4. For excellent performance of the toner supply roll 26, the openings 40 are dimensioned such that the diameter of the openings 40 is held within a range of 100–800 μm, preferably, 200–700 μm. If the diameter of the openings 40 is smaller than the lower limit of 100 μm, the powdered toner once admitted into the cells 30 through the openings 40 tends to be hardly discharged from the cells 38, resulting in local hardening of the polyurethane sponge structure 34. Thus, the quality of the reproduced image is undesirably deteriorated. If the diameter of the openings 40 is larger than the upper limit of 800 μm, an amount of the toner supplied from the toner supply roll 26 to the developing roll 28 is unfavorably reduced, also resulting in the image quality deterioration due to reduction of the toner concentration and occurrence of unprinted local portions in the reproduced image.

The soft polyurethane sponge structure 34 may be a continuously porous structure wherein the cells 38 communicate with each other, or an independent-cell type structure wherein the cells 38 do not communicate with each other. Preferably, the polyurethane sponge structure 34 is of the independent cell-type. More preferably, the polyurethane sponge structure 34 of the independent-cell type of the polyurethane sponge is formed so as to exhibit air permeability of 30 $cc/cm^2 \cdot sec$ or lower. The air permeability is measured in the following procedure. First, a specimen of the toner supply roll 26 is prepared by cutting the polyurethane sponge structure 34, so that the specimen has an axial length of 25 mm. Then, one of the axial ends of the specimen is exposed to the atmospheric pressure, while the other axial end is exposed to reduced pressure of 100 mm $H_2O$. The rate of air flow through the polyurethane sponge structure of the specimen per $cm^2$ in a period of one second is measured. The desired soft polyurethane sponge structure can be easily produced by suitably selecting the composition of the polyurethane material, and the amount of the polyurethane material which is injected into the mold, or by suitably selecting a crushing process (which will be described) to which the formed polyurethane sponge structure is subjected.

Figure 7:
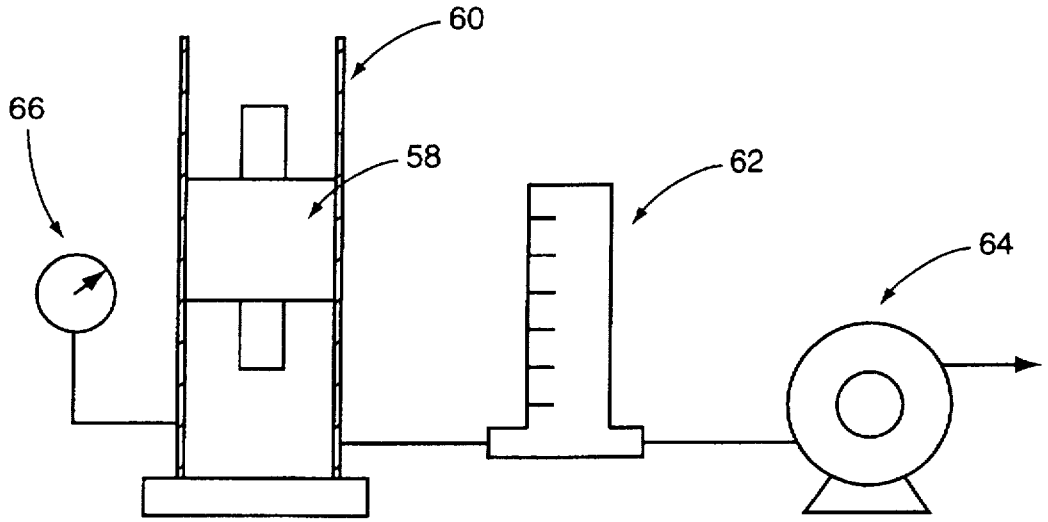
FIG. 7 is a view explaining a method of measuring a rate air flow through the soft polyurethane sponge structure of the toner supply roll.

More specifically, the rate of air flow through the polyurethane sponge structure 34 constructed as described above, may be measured by an apparatus constructed as shown in FIG. 7. First of all, there is prepared a toner supply roll having a polyurethane sponge structure whose air flow rate is measured. Then, the prepared toner supply roll is cut into a specimen 58 which has an axial length of 25 mm. The obtained specimen 58 is pushed into a cylinder 60 having an inside diameter slightly smaller than the outer diameter of the toner supply roll. For example, the inside diameter of the cylinder 60 is smaller by 1 mm than the outside diameter of the toner supply roll in Example 2 which will be described. One of the axial ends of the specimen 58 is exposed to the atmospheric pressure, while the other or opposite axial end of the specimen 58 cooperates with the cylinder 60 to define a chamber which communicates with a vacuum pump 64 via a flow meter 62. The vacuum pump 64 is activated to reduce the pressure in the above-indicated chamber in the cylinder 60. This pressure is measured by a pressure gage 66. When the pressure in the above chamber is equal to 100 mm $H_2O$, the quantity of air flow through the specimen 58 during a period of one second is measured by the flowmeter 62. The measured quantity is divided by the cross sectional area of the polyurethane sponge structure of the specimen 58, to thereby obtain the rate of an flow through the specimen 58.

The diameter of the cells 38 formed in the soft polyurethane sponge structure 34 of the toner supply roll 26 according to the present invention is larger than the diameter of the openings 40. The diameter of cells 38 is generally 100–1000 μm, and preferably 300–900 μm. If the cell diameter is excessively small (smaller than 100 μm), the diameter of the openings 40 is accordingly reduced, leading to the problem of local clogging of the polyurethane sponge structure with the toner, resulting in local hardening of the toner supply roll 26. If the cell diameter is excessively large, the powdered toner can easily enter the polyurethane sponge structure 34, also leading to significant hardening of the toner supply roll 26, resulting in deterioration of the reproduced image.

Figure 5A:
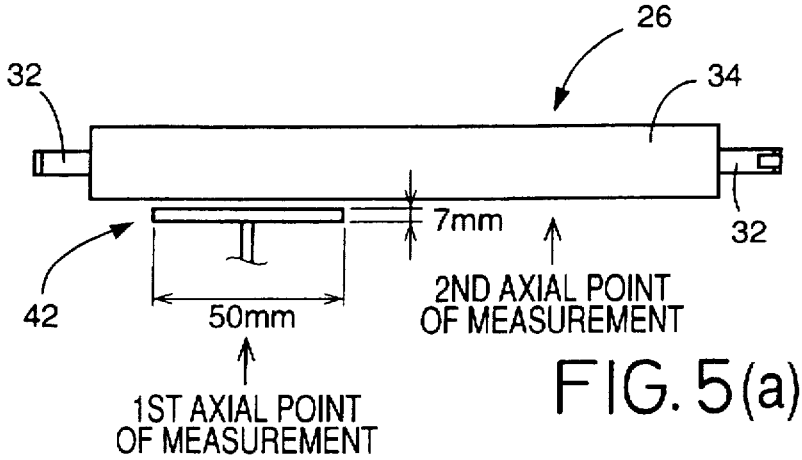
FIGS. 5(*a*) and 5(*b*) are respectively a plane view and an end view of the toner supply roll according to the present invention, both of which illustrate a method of measuring the hardness of the soft polyurethane sponge structure of the toner supply roll.
Figure 5B:
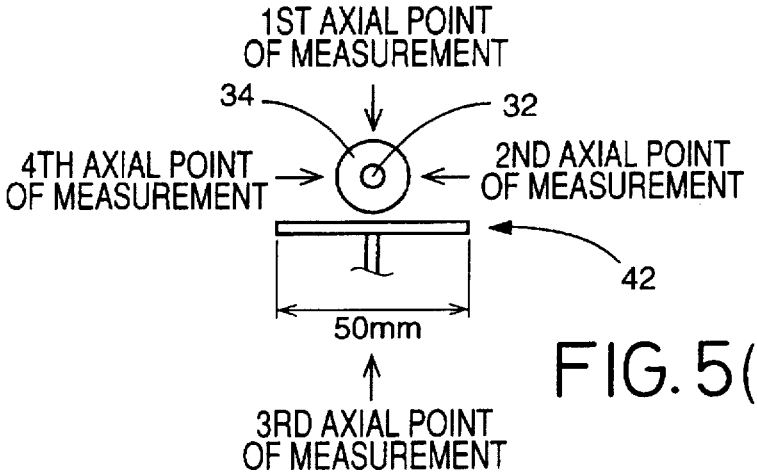

Further, the soft polyurethane sponge structure 34 of the toner supply roll 26 constructed according to the present invention is required to have its hardness of 350 g or lower. If the hardness of the toner supply roll 26 exceeds the upper limit of 350 g, the function of the roll 26 to supply the toner 24 to the developing roll 28 is deteriorated, so that the image reproduced on the developing roll is deteriorated. This deterioration can be confirmed by a test operation on the laser printer using the toner supply roll 26 under a low-temperature and low-humidity condition, namely at 15° C. and 10% humidity. The hardness of the toner supply roll 26 as described above is measured as shown in FIGS. 5(*a*) and 5(*b*). Namely, the toner roll 26 is supported at the opposite axial ends of the metal shaft 32, as illustrated in FIGS. 5(*a*) and 5(*b*). A part of the polyurethane sponge structure 34 of the toner supply roll 26 is pressed at a speed of 10 mm/min, by a jig 42 including a presser plate which has a thickness of 7 mm. The presser plate is a rectangular plate having a dimension of 50 mm as measured in the axial direction of the toner supply roll 26 as indicated in FIG. 5(*a*), and a dimension of 50 mm as measured in the diametric direction of the roll 26 as indicated in FIG. 5(*b*). A load (g) is applied to the surface of the sponge structure 34 in the radial direction to cause radial displacement of 1 mm of the sponge structure 34. This load represents the hardness of the sponge structure 34. The hardness of the polyurethane sponge structure 34 increases with an increase of the applied load (g). As is apparent from FIGS. 5(*a*) and 5(*b*), the applied load (g) is measured at two axial points of the toner supply roll 26 which are spaced apart from each other by a suitable distance in the axial direction, and at four circumferential points of the toner supply roll 26 which are equally spaced apart from each other at an angular interval of 90°. Thus, the load applied to the toner supply roll 26 is measured at a total of eight points. An average of the eight load values measured represents the hardness of toner supply roll 26. The soft polyurethane sponge structure 34 having the hardness of not higher than 350 g as described above may be easily obtained by selecting the composition of the soft polyurethane material material and the amount of the material injected into the mold. Especially, the polyurethane sponge structure 34 having a desired hardness corresponding to the specific amount of the material can be obtained by using a mold which employs a pipe as described below.

The skin layer 36 and the adjacent cellular structure of the toner supply roll 26 as shown in FIG. 3(*a*) according to the present invention is distinguished from the surface structure of the known toner supply rolls formed according to the conventional methods as described above, which are shown in FIGS. 3(*b*) and 3(*c*).

Namely, the toner supply roll 26' shown in FIG. 3(*b*) is formed according to the conventional method (A) or (B) described above, wherein the polyurethane sponge structure 34' formed around the metal shaft 32' is subjected to a grinding or polishing operation on its surface, so that the ground or polished surface of the polyurethane sponge structure 34' is fluffed with burrs or fuzz 44. The burrs 44 may be peeled off from the surface of the polyurethane structure 34'. The removed burrs 44 may cause problems as foreign matters in the laser printer, and may lower the dimensional accuracy of the toner supply roll 26'. Referring next to FIG. 3 (*c*), the toner supply roll 26" shown therein is formed according to the conventional method (C) described above, wherein the polyurethane sponge structure 34" is formed around the metal shaft 32". On the surface of the polyurethane sponge structure 34", there is formed a skin layer 46 as indicated in enlargement FIG. 3(*c*). In the toner supply roll 26", cells 38" disposed adjacent to the skin layer 46 are not open in the surface of the skin layer 46, so that the thickness of the skin layer 46 is reduced at portions thereof right above the cells 38". Thus, the thinned portions of the skin layer 46 tend to be broken or torn, causing fragments of the skin layer 46 to be removed as foreign substances. Further, through the thus opened portions of the skin layer 46, the toner may enter the inside of the polyurethane sponge structure 34, resulting in local hardening of sponge structure 34".

In the toner supply roll 26 according to the present invention as shown in FIG. 3(*a*), the skin layer 36 has a generally continuous smooth circumferential surface. The skin layer 36 assures improved dimensional accuracy of the roll 26. Further, the skin layer 36 has the openings 40 communicating the cells 38. Since the openings 40 are located at the portions of the skin layer 36 which are aligned with the central portions of the cells 38 in the axial and radial directions of the cylindrical sponge structure 34 (metal shaft 32), the skin layer 36 does not have the thinned portions as provided in the skin layer 46 of the conventional roll 26" of FIG. 3(*c*). Thus, the present toner supply roll 26 effectively eliminates the conventional problems of fluffing on the surface of the toner supply roll and removal of burrs 44 from the surface of the toner supply roll, and removal of fragments of the skin layer. Further, the local hardening of the sponge structure 34 is not caused, since the toner 24 does not enter into the cellular portion of the sponge structure 34.

For effectively producing the toner supply roll 26 constructed according to the present invention, the following two kinds of methods of production may be employed. According to the present methods of producing the toner supply roll 26, the soft polyurethane sponge structure 34 is formed by foam molding of the polyurethane material, such that the openings 40 are formed through the skin layer 36, so that the cells 38 right below the openings 40 are open to the atmosphere through the openings 40.

There will first be described the first method of producing the toner supply roll 26. According to the first method, the mold is prepared such that at least a portion of the mold having its inner surface which which defines a mold cavity whose configuration corresponds to the shape of the roll 26, is formed of a fluoro-resin material, while the inner surface of the mold is processed to have a surface roughness of Rz 5–20 μm. Then, the foam-molding of the polyurethane material is executed in the mold as follows. Namely, the metal shaft 32 is disposed in the mold cavity, and then the polyurethane material is introduced into the mold cavity. The polyurethane material is foamed in the mold, so that the soft polyurethane sponge structure 34 is formed on the outer circumferential surface of the metal shaft 32, such that the skin layer 36 is formed on the outer circumferential surface portion of the polyurethane sponge structure 34. The skin layer 36 has the openings 40 which are formed through the skin layer 36 at respective portions of the skin layer 36, through which the cells 38 located just under the skin layer 36 are open to the atmosphere. When the polyurethane material in a liquid state is foamed in the mold constructed as described above, the fluoro-resin material which provides at least the inner surface of the mold exhibits water repellency and surface tension with respect to the polyurethane material. Further, the inner surface of the mold is suitably adjusted a desired roughness (Rz). As a result, the polyurethane material is absent at those portions of the skin layer 36 which are adjacent to the cells 38 formed in the polyurethane sponge structure 34, i.e., at the portions of the skin layer 36 which are aligned with the center portions of the cells 38 right under the skin layer 36 and which would otherwise be thinned. Thus, the openings 40 are formed through the skin layer 36 of the polyurethane sponge structure 34, so that the cells 38 are open in the surface of the skin layer 36.

In the first method of producing the toner supply roll 26, at least the inner portion of the the mold which defines the mold cavity is formed of appropriate fluoro-resin material. However, the mold may be entirely formed of the fluoro-resin material. The inner surface of the mold which is partly or entirely formed of the desired fluoro-resin material is subjected to a roughing process as well known in the art, such as shot blasting, such that the inner surface of the mold has the surface roughness (Rz) of 5–20 μm. If the surface roughness (Rz) of the inner surface of the mold is smaller than 5 μm, the openings 40 formed in the skin layer 36 of the polyurethane sponge structure 34 do not have a sufficiently large size. On the other hand, if the surface roughness (Rz) of the inner surface of the mold exceeds the upper limit of 20 μm, the obtained toner supply roll 26 cannot be easily removed from the mold, without breakage or tearing of the skin layer 36 and breakage or damage of the sponge structure 34.

Any fluoro-resin which is well known in the art may be used for forming at least the inner portion of the mold. Preferably, the following fluoro-resin materials may be used: polytetrafluoroethylene (PTFE); a copolymer of tetrafluoroethylene and hexafluoropropylene (FEP); a copolymer of tetrafluoroethylene and perfluoro (alkyl vinyl ether) (PFA); a copolymer of tetrafluoroethylene-hexafluoropropylene-perfluoro (propyl vinyl ether) (EPE); polychlorotrifluoroethylene (PCTFE); polyvinylidene fluoride (PVDF); an alternative copolymer of ethylene and tetrafluoroethylene (ETFE); an alternative copolymer of ethylene and chlorotrifluoroethylene (ECTFE); and polyvinyl fluoride (PVF).

There will next be described the second method of producing the toner supply roll of the present invention. In the second method, a mold is prepared such that a fluoro-resin coating layer is formed on the inner surface of the mold, so that the coating layer defines a mold cavity which corresponds to the desired shape of the roll 26. The fluoro-resin coating layer is processed so as to have a surface roughness of 5–20 μm (Rz). In the prepared mold, a cylindrical soft polyurethane sponge structure 34 is formed by foam-molding on the metal shaft 32, as in the first method. The fluoro-resin coating layer formed on the inner surface of the mold exhibits water repellency and surface tension with respect to polyurethane material. Further, the roughness (Rz) of the inner surface of the mold is adjusted to 5–20 μm. As a result, the openings 40 are effectively formed with a suitable size in the skin layer 36 of the soft polyurethane sponge structure 34 prepared by a foam-molding of the polyurethane material. The openings 40 formed right under the cells 38 communicate with these cells and are open in the surface of the skin layer 36.

The fluoro-resin material used for forming the fluoro-resin coating layer on the inner surface of the mold according to the second method may be selected from the fluoro-resins used in the first method. The fluoro-resin coating layer may be formed with a desired thickness of the selected fluoro-resin material as well known in the art. Further, the surface of the fluoro-resin coating layer is subjected to a roughing process, such as shot blasting, so that the fluoro-resin coating layer has the surface roughness of 5–20 μm (Rz). If the surface roughness (Rz) of the fluoro-resin coating layer is outside the specified range of 5–20 μm, the same problems as described above with respect to the first method are encountered, and the objects of the present invention are not fully achieved.

Both of the above-mentioned first and second methods may further comprise the step of applying a mold releasing agent to the inner surface of the mold, i.e., the surface of the mold cavity, which have been processed to have the specified surface roughness. The mold released agent is very effective to form the soft polyurethane sponge structure 34 with the openings 40 according to the present invention. Thus, the inner surface of the mold coated with the mold releasing agent exhibits increased water repellency and surface tension, which permits the openings 40 to be formed in communication with the respective cells 38. The mold releasing agent may include, as a major component, silicone or fluorine, or other materials known in the art.

As the mold used in the first and second methods as described above, a mold using a pipe as shown in FIG. 6, namely, so-called a pipe type mold is preferably used. The inner surface of the pipe provides the mold cavity corresponding to the diameter of the soft polyurethane sponge structure 34 of the toner supply roll 26.

Figure 6:
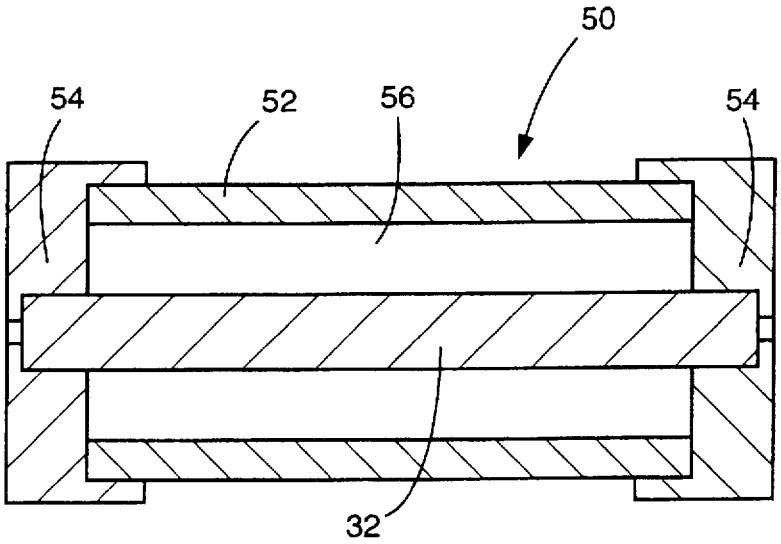
FIG. 6 is a longitudinal cross sectional view of one example of a mold which is used in one preferred embodiment of a method of the present invention producing the toner supply roll.

Referring to FIG. 6, there is shown a mold 50 which comprises a pipe 52 the axial length of which is equal to that of the soft polyurethane sponge structure 34, and a pair of end caps 54, 54 which are fixed to close the opposite axial open ends of the pipe 52, respectively. The metal shaft 32 is disposed inside the pipe 52 and is supported at its axial ends by the pair of end caps 54, 54, respectively. Thus, a desired mold cavity 56 is defined by the pipe 52, metal shaft 32 and end caps 54. This mold cavity 56 is adapted to form the desired sponge structure 34 having the desired outside diameter and axial length.

According to the first method of producing the toner supply roll 26, the entirety of the pipe 52 or at least the inner portion of the pipe 52 is formed by the fluoro-resin material, and the surface of the pipe 52 is processed to have the predetermined roughness. According to the second method, the inner surface of the pipe 52 is covered by the fluoro-resin coating layer the surface of which is processed to have the predetermined roughness (Rz).

In the method of producing the toner supply roll according to the present invention, the soft polyurethane sponge structure 34 is formed by foam-molding of the polyurethane material in the mold cavity 56 of the mold 50. The polyurethane material is introduced into the mold cavity 56, in a liquid state, as in the conventional method, and may be selected preferably from the known group of reactive materials such as a mixture of polyol and polyisocyanate, which are foamed and cured in the mold.

More specifically described, the polyol component of the liquid polyurethane material may be any one of polyols selected from the group consisting of polyether polyol, polyester polyol, polymer polyol, and the like, which are conventionally used in the art to make a soft polyurethane foam in general. The polyisocyanate component, on the other hand, may be any one of polyisocyanates having at least two functional groups as well known in the art. More specifically, the polyisocyanate component may preferably include at least one of 2,4- and 2,6-tolylenediisocyanate (TDI), orthtoluidinediisocyanate (TODI), naphthylenediisocyanate (NDI), xylenediisocyanate (XDI), 4,4'-diphenylmethandiisocyanate (MDI), MDI modified by carbodiimide, polymethylene polyphenylisocyanate, polymeric polyisocyanate, and the like.

To the polyurethane material including the polyol and polyisocyanate components, there may be added a cross-linking agent, a foaming agent (e.g., water, a substance having a low boiling point, gas), a surface active agent, a catalyst, or the like, to provide a reactive foamable composition which is suitable to obtain the desired polyurethane sponge structure 34 by foaming, namely, the sponge structure having a continuous network of cells or a network of cells which are independent of each other. The reactive foamable composition may further comprise a fire retardant and/or a filler as needed, and may further comprise an electrically conductive additive and/or an antistatic agent, as in the conventional method. The electrically conductive additive gives the desired electrical conductivity to the toner supply roll.

The liquid polyurethane material is injected into the mold cavity 56 of the mold 50 as shown in FIG. 6, and then the material is foamed in the conventional method. In this case, the starting polyurethane material is generally expanded by about 5–20 times. The material thus foamed in the mold cavity 56 gives the soft polyurethane sponge structure 34 formed on the metal shaft 32 such that the hardness of the polyurethane sponge structure 32 is 350 g or lower, and each opening 40 has the diameter of 100–800 μm, while the total area of the openings 40 is at least 20% of the total surface area of the skin layer 36. The obtained toner supply roll 26 removed from the mold 50 is provided with the skin layer 36 having the mutually independent openings 40 which are open in the skin layer 36 and which communicate with the cells 38 adjacent to the skin layer 36. The openings 40 are given the suitable size owing to the properties of the inner surface of the mold 50, i.e., the inner surface of the pipe 52, as described above. The formed polyurethane sponge structure 34 may preferably be processed by crushing with compressed air having a suitable pressure being blown against the surface of the polyurethane sponge structure 34. For forming the independent-cell type polyurethane sponge structure 34, it is desirable that the polyurethane material be mechanically foamed. In this case, it is desirable to reduce the pressure of the compressed air used in the crushing process.

According to the present invention, the toner supply roll 26 obtained by foaming the polyurethane material in the mold can be used as a component of each developing unit 20. Thus, the cumbersome procedure such as a grinding step which is required in the conventional method may be eliminated according to the present invention. Thus, the toner supply roll may be simply produced according to the present invention. Moreover, the toner supply roll 26 according to the present invention has improved dimensional accuracy and is free from the burrs or fuzz formed on the surface of the toner roll 26, breakage of the skin layer 36, and removal of fragments from the sponge structure 34, while improving the dimensional accuracy.

EXAMPLES

There will be next described in detail about preferred examples of the present invention, to further clarify the principle of the present invention. It is to be understood that the invention is not limited to the details of the following examples, but may be embodied, with various changes, modifications and improvements, which may occur to those skilled in the art, without departing from the spirit of the present invention.

Example 1

Initially, the pipe type mold (50) as shown in FIG. 6 was prepared such that the inner surface of the pipe (52) made of metal is coated by fluoro-resin (PTFE), and the surface of the PTFE coating was processed by shot blasting so as to have the predetermined surface roughness (RZ). In another pipe type mold (50), the entirety of the pipe (52) was formed of PTFE, and the inner surface of the pipe (52) was processed so as to have the predetermined surface roughness (Rz). A further pipe type mold (50) was prepared with the inner surface of the pipe (50) being processed to have the desired roughness and coated with a commercially available mold releasing agent of fluorine type or silicone type.

Three polyurethane compositions A, B, and C as indicated in Table 1 were prepared by mixing the components whose contents are indicated in the table.

The prepared three polyurethane compositions A, B and C were then foamed in the prepared molds (50) whose pipes (52) have different inner surface conditions as indicated in Table 2, whereby toner supply rolls (26) were obtained, each having the soft polyurethane sponge structure (34) formed on the metal shaft (32).

The obtained toner supply rolls (26) were examined in term of the hardness of their polyurethane sponge structures (34), in the manner as shown in FIGS. 5(*a*) and 5(*b*). The polyurethane sponge structures (34) were further examined in terms of the cell diameter, surface area percent

TABLE 1

| | POLYURETHANE COMPOSITIONS | | |
|---|---|---|---|
| COMPONENTS | A (wt/%) | B (wt/%) | C (wt/%) |
| FA-718[1)] | 90 | 90 | 90 |
| POP-31-28[2)] | 10 | 10 | 10 |
| diethanol amine | 0.5 | 0.5 | 0.5 |
| KAOLIZER No. 1[3)] | 0.5 | 0.5 | — |
| KAOLIZER No. 31[4)] | — | — | 0.5 |
| TOYOCAT HX-35[5)] | 0.1 | 0.1 | 0.1 |
| water | 2.0 | 2.0 | 2.0 |
| SZ-1313[6)] | 1.0 | 1.0 | 1.0 |
| SUMIDUR VT-80[7)] | 30.1 | 27.0 | 27.0 |

[1)]polyether polyol (OH = 28) available from SANYO CHEMICAL INDUSTRIES, LTD.
[2)]polymer polyol (OH = 28) available from MITSUI TOATSU CHEMICALS, INC.
[3)] and [4)]tertiary amine catalyst available from KAO CORPORATION
[5)]tertiary amine catalyst available from TOSOH CORPORATION
[6)]foaming agent of silicone type available from NIPPON YUNICOR KABUSHIKI KAISHA
[7)]isocyanate (NCO% = 44.5) available from SUMITOMO BAYER URETHANE KABUSHIKI KAISHA of the openings (40) in the polyurethane sponge structure (34), and the diameter of the openings. The results of those measurements are also indicated in Table 2. Further, the obtained toner supply rolls were incorporated in a laser printer, and printing operations were performed to reproduce an image. The test results are also indicated in Table 2. Namely, the laser printer using each toner supply roll was operated to reproduce 100,000 copies of the image, using a toner having average particle of 7–10 μm, under a low-temperature and low-humidity condition (15° C. and 10% humidity). The quality of the image obtained in the initial period of the test operation was compared with the quality of the image obtained at the end of the test operation, in term of the toner concentration and occurrence of linear unprinted areas which should have been imaged. In Table 2, "O" represents 10% reduction of the toner concentration (no linear unprinted areas), "Δ" indicates 10–25% reduction of the toner concentration (no linear unprinted areas), and "x" indicates 25%–50% reduction of the toner concentration and the occurrence of the linear unprinted areas.

As is apparent from Table 2, any one of the specimen Nos. 1–6 according to the present invention, provided an excellent image quality. On the other hand, the comparative specimen No. 2 suffered from deteriorated durability and poor image quality, due to local breakage of the skin layer (36) and absence of the openings (40) communicating with the cells (38) adjacent to the skin layer (36). In the comparative specimen No. 3 the surface of the polyurethane sponge structure (34) was finished by grinding as in the conventional method. While the comparative specimen No. 3 provided satisfactory image quality, some burrs were formed on the surface of the polyurethane sponge structure (34), and were considered to be removed during use of the toner supply roll, giving an adverse influence on the transfer of the toner to the developing roll.

38 just under the skin layer 36. The openings 40 have the diameter of 100 μm–800 μm and are formed independently of each other. The skin layer 36 has a generally smooth surface. Unlike the continuous-cell type sponge structure 34 of the toner supply roll 26, the independent-cell type polyurethane sponge structure 72 of the roll 70 exhibits relatively reduced air permeability of 30 cc/cm$^2$ or lower.

In the toner supply roll 70 constructed as described above, the cells 38 are substantially independent of each other, and have reduced mutual communication. Therefore, the toner which has passed through the openings 40 and entered the relatively outer cells 38 adjacent to the skin layer 36, is less likely to flow into the relatively inner cells 38, even if the toner powder has a relatively small particle size. The toner supply roll 70 is effectively prevented from suffering from hardening thereof due to clogging the cells 38 with the toner powder.

For preparing the toner supply roll 70 of the independent-cell type as described above, a mold (50) as shown in FIG. 6 was initially prepared, as in Example 1, such that the pipe (52) made of metal is covered by a fluoro-resin (PTFE) coating which is processed by shot blasting to have a desired surface roughness (Rz). Another mold (50) was prepared using the pipe (52) without the PTFE coating, and by roughening the inner surface of the pipe by shot blasting. The inner surface of the metal pipe (52) of this second mold was coated with a commercially available mold releasing agent comprising fluorine. In the meantime, four polyurethane compositions D, E, F and G were prepared by mixing the component whose contents are indicated in Table 1. The metal pipes 52 of the prepared molds 50 have different

TABLE 2

| | COMPOSITION | MOLD | HARDNESS (g) | CELL DIAMETER (μm) | OPENING AREA (%) | OPENING DIAMETER (μm) | IMAGE QUALIT |
|---|---|---|---|---|---|---|---|
| PRESENT INVENTION | | | | | | | |
| 1 | A | PTFE COATING Rz = 20 μm | 298 | 820–410 | 66.1 | 700–350 | 602 |
| 2 | B | PTFE COATING*1 Rz = 20 μm | 211 | 850–390 | 69.0 | 700–350 | ○ |
| 3 | A | PTFE COATING*2 Rz = 20 μm | 285 | 680–440 | 70.0 | 690–400 | ○ |
| 4 | A | PTFE COATING Rz = 10 μm | 296 | 850–400 | 62.6 | 430–230 | ○ |
| 5 | A | PTFE PIPE Rz = 5 μm | 302 | 780–370 | 27.1 | 290–220 | ○ |
| 6 | A | PTFE PIPE Rz = 10 μm | 281 | 720–270 | 20.3 | 200–140 | ○ |
| COMPARATIVE EXAMPLES | | | | | | | |
| 1 | C | PTFE PIPE Rz = 10 μm | 296 | 660–410 | 10.1 | 190–120 | Δ |
| 2 | A | PTFE PIPE MIRROR FINISH | 283 | 750–330 | 0 | no-openings | X |
| 3 | A | GRINDING FINISH | 178 | — | — | — | ○ |

*1Inner surface is coated with mold releasing agent comprising fluorine.
*2Inner surface is coated with mold releasing agent comprising silicone.

Example 2

Figure 8:
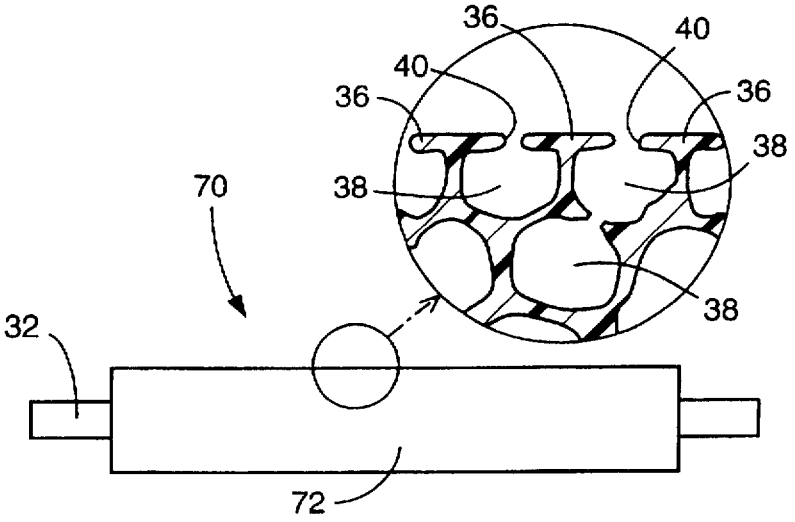
FIG. 8 is an enlarged view of a toner supply roll constructed according to another embodiment of the present invention.

Referring next to FIG. 8, there is shown a toner supply roll 70 having a cylindrical soft polyurethane sponge structure 72 of independent-cell type formed on the metal shaft 32. Several specimens of this toner supply roll 70 were prepared, in substantially the same manner as the toner transfer roll 26 having the continuous-cell type soft polyurethane sponge structure 34 of FIG. 3(*a*). The polyurethane sponge structure 72 has the openings 40 formed through the skin layer 36 and communicating with the respective cells diameters, namely, 16 mm and 13 mm which correspond to the outside diameters of two kinds of the toner supply roll (70).

The four polyurethane compositions D, E, F, G, prepared from the components indicated in Table 3, were foamed in the prepared molds (50) whose pipes (52) have different inner surface conditions. Combination of the polyurethane compositions D, E, F, G and the molds (50) used are indicated in Table 4. After the foaming process, the outer surface of the formed polyurethane sponge structure was crushed with compressed air, as needed. Thus, there were

TABLE 3

| COMPONENTS | POLYURETHANE COMPOSITIONS D (wt/%) | E (wt/%) | F (wt/%) | G (wt/%) |
|---|---|---|---|---|
| FA-718[1)] | 100 | 100 | 90 | 90 |
| POP-31-28[2)] | — | — | 10 | 10 |
| triethanol amine | 2 | 2 | 1 | 1 |
| water | 2.5 | 2.5 | 2.3 | 2.5 |
| SZ-1313[3)] | 1 | 1 | 1 | — |
| SZ-1142[4)] | — | — | — | 0.1 |
| KAOLIZER No. 31[5)] | 0.5 | 0.5 | 0.2 | 0.5 |
| TOYOCAT ET[6)] | | | | |
| TOYOCAT HX-35[6)] | — | — | 0.2 | — |
| SUMIDUR VT-80[8)] | 27.7 | 31.2 | 24.6 | 26.2 |

[1)]polyether polyol (OH = 28) available from SANYO CHEMICAL INDUSTRIES, LTD.
[2)]polymer polyol (OH = 28) available from MITSUI TOATSU CHEMICALS, INC.
[3), 4)]foaming agent of silicone type available from NIPPON YUNICOR KABUSHIKI KAISHA
[5)]tertiary amine catalyst available from KAO CORPORATION
[6), 7)]tertiary amine catalyst available from TOSOH CORPORATION
[8)]isocyanate (NCO% = 44.5) available from SUMITOMO BAYER URETHANE KABUSHIKI KAISHA produced the toner supply rolls (70) each having the outer diameter of 16 mm or 13 mm and comprising the metal shaft (32) and the polyurethane sponge structure (72) having a predetermined softness formed on the outer circumferential surface of the metal shaft (32). Comparative specimen Nos. 4–6 were also produced. The comparative specimen No. 6 was prepared by a block molding process in which the polyurethane composition was foamed in a conventional box-like mold (300 mm×500 mm×500 mm) to form an polyurethane sponge structure on the metal shaft disposed therein, and then the unnecessary portion of the sponge structure was removed by grinding, to obtain the final polyurethane sponge structure (72).

The obtained specimen of the toner supply rolls 70 were examined in the term of the air flow rate of the polyurethane sponge structure (72) in the method described above. As in Example 1, the toner supply rolls (70) were further examined in terms of the hardness of their polyurethane sponge structures (72), cell diameter, surface area percent and diameter of the openings (40) in the polyurethane sponge structure (72). The measurements are indicated in Table 4. The quality of the image reproduced using the obtained toner supply rolls were examined before and after a test operation, which was performed in substantially the same manner in Example 1. The examined image quality is indicated in Table 4.

Figure 9A:
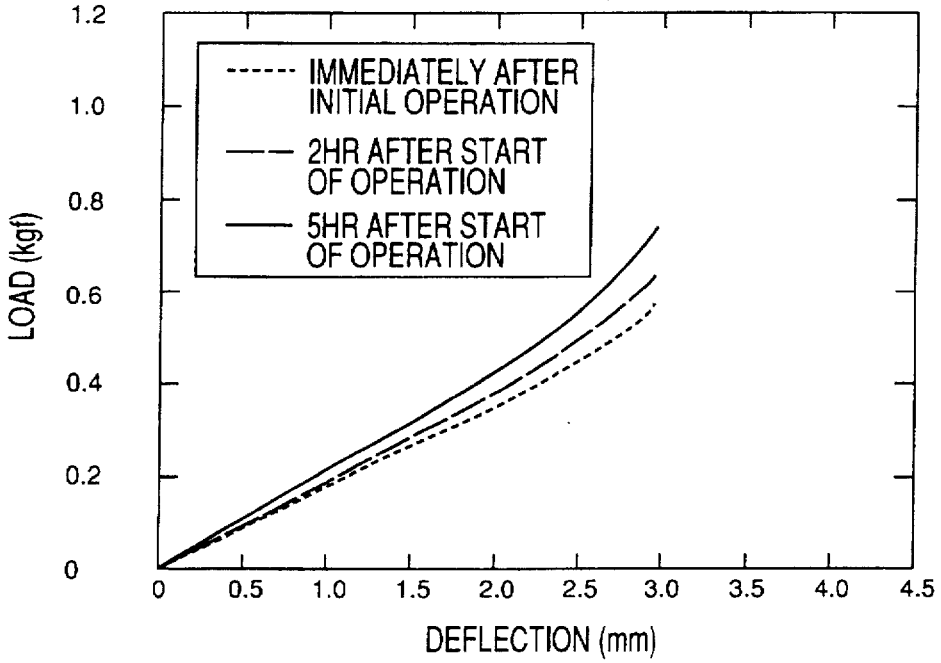
FIGS. 9(*a*) and 9(*b*) are graphs showing a relationship between a load applied to the toner supply roll and an amount of deflection of the toner supply roll, FIG. 9(*a*) showing measurements of the toner supply roll of the invention, while FIG. 9(*b*) showing measurements of the conventional toner supply roll.
Figure 9B:
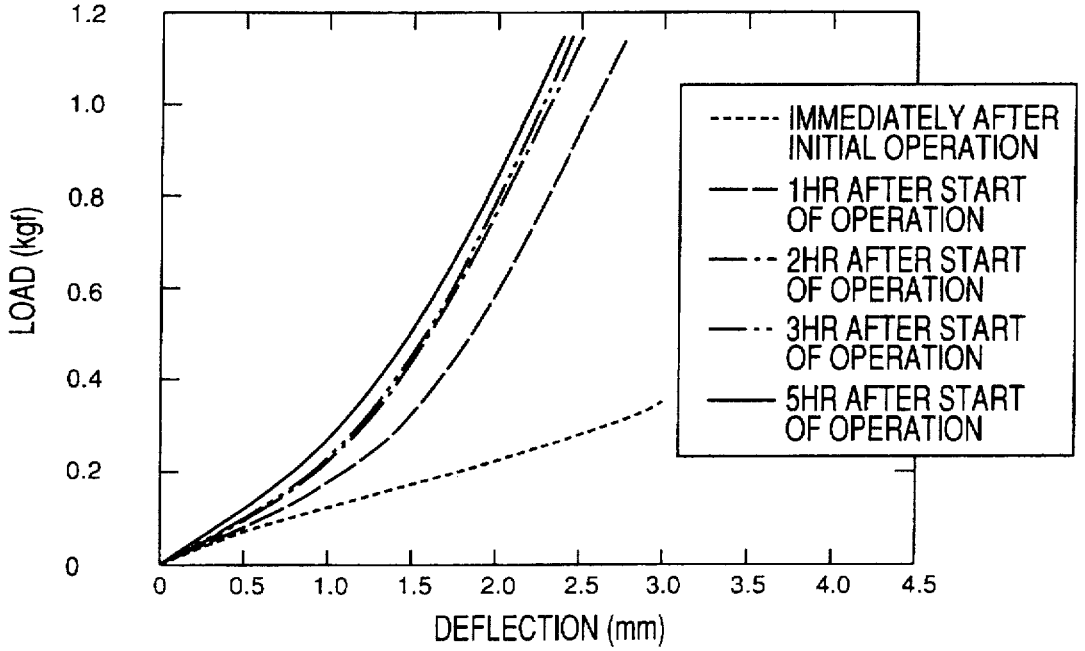
FIG. 9(b) PRIOR ART

More specifically described, the test was conducted to evaluate the reproduced image quality in the following manner. Initially the toner supply roll (70) having the outer diameter of 16 mm was installed in a laser printer "Color Laser Writer 12/600PS" available from Apple Corporation, while the toner supply roll (70) having the outer diameter of 13 mm was installed in an electrophotographic copying machine "FC-330" available from Canon Corporation. Both of the laser printer and the copying machine reproduced 100,000 copies of an image by using a toner having an average particle size of 5–7 μm, at 15° C. and 10% humidity. The particles size of the toner used in Example 2 is smaller than that of the toner used in Example 1. The image obtained in the initial period of the test was compared with the image obtained at the end of the test, in terms of the toner concentration and occurrence of the linear unprinted areas that should be imaged in fact. In table 4, "O" represents 10% reduction of the toner concentration (no linear unprinted areas), "Δ" indicates 10–25% reduction of the toner concentration (no linear unprinted areas), and "x" indicates 25%–50% reduction of the toner concentration and the occurrence of the linear unprinted areas. The toner supply rolls of the specimen No. 12 of the present invention and the comparative specimen 6 were subjected to a varying load in the radial direction, and the amount of radial deflection of the sponge structure was measured following the above-described hardness measuring method of FIGS. 5(*a*) and 5(*b*). The test was conducted immediately after the start of the test, and when the predetermined times have passed after the start of the test. The obtained relationships between the applied load and the deflection are indicated in FIG. 9.

As is apparent from Table 4, all of the specimen Nos. 7, 8 and 10–14 of the present invention which meet the requirement of the air flow rate of the polyurethane sponge

TABLE 4

| | | COMPOSITION | DIA. (mm) | METHOD | SURFACE ROUGHNESS Rz (μm) | MATERIAL WEIGHT (g) | POROSITY OPENING IMAGE HARDNESS | CELL DIA. (μm) | OPENING AREA (%) | OPENING DIA. (μm) | AIR* FLOW RATE | IMAGE QUALITY INITIAL | AFTER |
|---|---|---|---|---|---|---|---|---|---|---|---|---|---|
| PRESENT INVENTION | 7 | D | 16 | I | 10–20 | 6 | 250 | 400–850 | 60.0 | 230–430 | 20 | ○ | ○ |
| | 8 | E | 16 | I | 10–20 | 6 | 350 | 400–850 | 60.0 | 230–430 | 20 | ○ | ○ |
| | 9 | F | 16 | II | 10–20 | 6 | 200 | 400–800 | 60.0 | 300–450 | 36 | ○ | Δ |
| | 10 | F | 16 | II | 10–20 | 7 | 300 | 390–800 | 60.0 | 230–370 | 25 | ○ | ○ |
| | 11 | G | 16 | I | 5–10 | 6 | 280 | 400–760 | 30.0 | 180–250 | 25 | ○ | ○ |
| | 12 | D | 16 | I | 10–20 | 5 | 180 | 450–880 | 60.0 | 300–470 | 25 | ○ | ○ |
| | 13 | F | 13 | II | 10–20 | 4 | 180 | 410–830 | 60.0 | 210–410 | 20 | ○ | ○ |
| | 15 | G | 13 | III | 10–20 | 4 | 250 | 430–840 | 60.0 | 230–430 | ○ | ○ | |
| COMPARATIVE EXAMPLES | 4 | E | 16 | I | 10–20 | 7 | 450 | 390–820 | 60.0 | 220–390 | 17 | X | X |
| | 5 | G | 16 | III | 5–10 | 6 | 280 | 400–600 | 8.0 | 110–170 | 15 | ○ | X |
| | 6 | D | 16 | IV | — | 0.08[1)] | 140 | 420–850 | 70.0 | — | 50 | ○ | X |

I): Pipe mold whose inner surface is coated with mold releasing agent comprising fluorine, and crushed.
II): Pipe mold whose inner surface is coated with mold releasing agent comprising fluorine, and is not crushed.
III): Pipe mold whose inner surface is covered by crushed PTFE coating.
IV): Box-like mold whose inner surface is crushed and requires grinding to shape sponge structure.
*$cc/cm^2 \cdot sec$
[1)]density ($g/cm^3$)

structure permitted satisfactory image quality in the initial and terminal periods of the test. In the comparative specimen No. 4, however, the toner supply roll whose polyurethane sponge structure has a hardness exceeding the upper limit of the specified range of the present invention exhibited poor image even at the beginning of the test, due to insufficient flexibility of the polyurethane sponge structure. In comparative specimen Nos. 5 and 6, the image quality was satisfactory at the beginning of the test, but not satisfactory at the end of the test, since the toner supply roll of the comparative specimen No. 5 does not meet the requirement of the surface area percent of the openings in the skin layer 36, and the toner supply roll of the comparative specimen No. 6 was formed using the box-like mold rather than the pipe mold (50).

The graph of FIG. 9(*a*), represents a relationship obtained between the amount of load applied to the toner supply roll and the amount of radial deflection of the toner supply roll of the specimen No. 12 of the present invention, while the graph of FIG. 9(*b*) represents the same relationship of the comparative specimen No. 6. The comparison of the relationships indicated in there graphs indicates that the toner supply rolls according to the present invention exhibited higher stability of the relationship and maintain the initial hardness value even after the test, while the toner supply rolls of the comparative specimens had considerable change in the above-mentioned relationship and hardness.

Where the soft polyurethane sponge structure is an independent-cell type structure wherein the cells do not substantially communicate with each other, it is desirable that the sponge structure has an elongation of at least 100% and a tear strength of at least 0.4 kgf/cm, so that the sponge structure is less likely to suffer from breakage or tearing of the walls of the cells during use of the roll for a long period of time, which breakage or tearing of the cell walls would cause an undesirable increase in the air permeability of the cellular structure. In other words, the sponge structure having such high degree of elongation and tear strength is substantially free from the conventionally encountered problems such as the local hardening of the polyurethane sponge structure due to the toner caught in the broken cells and the resulting deterioration of the quality of the reproduced image.

The independent-cell type polyurethane sponge structure may be obtained by suitably selecting the polyurethane material, for instance, by using two or more appropriate polyisocyanate components having a high degree of purity, or using high-molecular weight polyol components. For example, the polyurethane material may include a combination of MDI and TDI wherein the content of TDI is made larger than that of MDI. Alternatively, the polyurethane material may include MDI having a relatively high degree of purity, or a polyol component having a comparatively high molecular weight (at least 5000, and preferably at least 10000), such as polyether polyol or polymer polyol.

It will be understood from the above description, that the toner supply roll constructed according to the present invention comprises a metal shaft, and a cylindrical soft polyurethane sponge structure which is formed integrally on the outer circumferential surface of the metal shaft and which has a skin layer. In the skin layer, there are formed a multiplicity of openings communicate with cells located adjacent to the skin layer, so that the cells are open to the atmosphere through the openings. The toner supply roll of the present invention is not subjected to a grinding or polishing operation as performed in the conventional method, so that the outer surface of the toner supply roll is not fluffed with burrs or fuzz, which may cause deterioration of the quality of the reproduced image, and which may be removed during use of the roll.

In the toner supply roll of the present invention, the skin layer of the soft polyurethane sponge structure has the openings, which are formed at the portions of the skin layer which are thinned in the presence of the cells. This arrangement is effective to prevent the breakage of the skin layer, which would cause the toner to enter the inside of the sponge structure and consequently cause local hardening of the sponge structure due to its clogging with the toner.

The method of producing the toner supply roll according to the present invention permits easy and reliable production of the desired toner supply roll by simply foaming the polyurethane sponge material on the metal shaft within the appropriate mold, without requiring the conventional grinding process while assuring improved dimensional accuracy of the toner supply roll.

What is claimed is:

1. A toner supply roll comprising:

a metal shaft; and a cylindrical soft polyurethane sponge structure formed on an outer circumferential surface of said metal shaft by foam molding of a polyurethane material in a mold cavity of a mold, which mold cavity has a configuration corresponding to a desired shape of said sponge structure, said cylindrical soft polyurethane sponge structure having a hardness of not higher than 350 g, and including a skin layer which has a generally smooth surface, said cylindrical sponge structure having a network of cells, and said skin layer having openings which are open in said generally smooth surface thereof and which communicate with respective ones of said cells which are located adjacent to said skin layer, said openings being substantially aligned with central portions of said respective ones of said cells in axial and radial directions of said cylindrical sponge structure, and each of said openings having a size within a range of 100–800 μm, and a total area of said openings being at least 20% of a total area of said generally smooth surface of said skin layer.

2. A toner supply roll according to claim 1, wherein said cylindrical soft polyurethane sponge structure has air permeability which permits a rate of air flow therethrough of not higher than 30 $cc/cm^2$·second when one of axial opposite ends of said sponge structure is exposed to an atmospheric pressure while the other of said axial opposite ends is exposed to a reduced pressure of 100 mm $H_2O$.

3. A toner supply roll according to claim 1, wherein said hardness is expressed by a load (g) which is applied to said cylindrical soft polyurethane sponge structure in a radial direction thereof and which causes a radial deflection of 1 mm of said sponge structure in said radial direction.

4. A toner supply roll according to claim 1, wherein said total area of said openings is not higher than 80% of said total area of said generally smooth surface of said skin layer.

5. A toner supply roll according to claim 1, wherein said size of said each opening is within a range of 200–700 μm.

6. A toner supply roll according to claim 1, wherein each of said cells has a size within a range of 100–1000 μm.

7. A toner supply roll according to claim 1, wherein each of said cells has a size within a range of 300–900 μm.

8. A toner supply roll according to claim 1 wherein said soft polyurethane sponge structure is an independent-cell type sponge structure wherein said cells do not substantially communicate with each other, said sponge structure having an elongation of at least 100% and a tear strength of at least 0.4 kgf/cm.

9. A method of producing a toner supply roll as defined in claim 1, comprising the steps of:

preparing said mold such that at least an inner portion of said mold which partially defined said mold cavity is formed of a fluoro-resin material;

processing a surface of said inner portion of said mold so that said inner portion has a surface roughness Rz of 5–20 μm;

disposing said metal shaft in said mold such that said metal shaft and said inner portion cooperate to define said mold cavity; and introducing said polyurethane material into said mold cavity and causing said polyurethane material to be foamed to generate said cylindrical soft polyurethane sponge structure integrally bonded to said outer circumferential surface of said metal shaft, said fluoro-resin material and said surface roughness of said inner portion of said mold permitting said openings to be formed through said skin layer of said cylindrical soft polyurethane sponge structure in communication with said respective ones of said cells.

10. A method of producing a toner supply roll as defined in claim 1, comprising the steps of:

preparing said mold such that an inner surface of said mold which partially defines said mold cavity is covered by a coating of a fluoro-resin material;

processing a surface of said coating of said fluoro-resin material so that said coating has a surface roughness Rz of 5–20 μm;

disposing said metal shaft in said mold such that said metal shaft and said coating cooperate to define said mold cavity; and introducing said polyurethane material into said mold cavity and causing said polyurethane material to be foamed to generate said cylindrical soft polyurethane sponge structure integrally bonded to said outer circumferential surface of said metal shaft, said fluoro-resin material and said surface roughness of said coating of said mold permitting said openings to be formed through said skin layer of said cylindrical soft polyurethane sponge structure in communication with said respective ones of said cells.

11. A method according to claim 9, further comprising a step of applying a mold releasing agent to said surface of said inner portion of said mold.

12. A method according to claim 10, further comprising a step of applying a mold releasing agent to said surface of said coating of said fluoro-resin material.

13. A method according to claim 9, wherein said step of preparing said mold comprises preparing a pipe as part of said mold, such that an inner circumferential surface of said pipe partially defines said mold cavity.

14. A method according to claim 10, wherein said step of preparing said mold comprises preparing a pipe as part of said mold, such that an inner circumferential surface of said pipe partially defines said mold cavity.

15. A method according to claim 13, wherein said step of preparing said mold comprises closing opposite axial ends of said pipe by respective end caps, and said step of disposing said metal shaft in said mold comprises assembling said pipe, said caps and said metal shaft such that said metal shaft is supported by said end caps.

16. A method according to claim 14, wherein said step of preparing said mold comprises closing opposite axial ends of said pipe by respective end caps, and said step of disposing said metal shaft in said mold comprises assembling said pipe, said caps and said metal shaft such that said metal shaft is supported by said end caps.

17. A method according to claim 9, wherein said fluoro-resin material and said surface roughness Rz are selected so as to permit said openings to be formed independently of each other, in communication with said respective ones of said cells.

18. A method according to claim 10, wherein said fluoro-resin material and said surface roughness Rz are selected so as to permit said openings to be formed independently of each other, in communication with said respective ones of said cells.

19. A method according to claim 9, wherein said polyurethane material comprises, as major components, a polyol component and an isocyanete component.

20. A method according to claim 10, wherein said polyurethane material comprises, as major components, a polyol component and an isocyanete component.

* * * * *